US007626563B2

(12) United States Patent
Kang et al.

(10) Patent No.: US 7,626,563 B2
(45) Date of Patent: Dec. 1, 2009

(54) PLASMA DISPLAY APPARATUS WHICH HAS AN IMPROVED DATA PULSE AND METHOD FOR DRIVING THE SAME

(75) Inventors: Seong Ho Kang, Daegu (KR); Jung Gwan Han, Gumi-si (KR)

(73) Assignee: LG Electronics Inc., Seoul (KR)

( * ) Notice: Subject to any disclaimer, the term of this patent is extended or adjusted under 35 U.S.C. 154(b) by 679 days.

(21) Appl. No.: 11/168,917

(22) Filed: Jun. 29, 2005

(65) Prior Publication Data

US 2006/0001603 A1 Jan. 5, 2006

(30) Foreign Application Priority Data

Jun. 30, 2004 (KR) ..... 10-2004-0050839

(51) Int. Cl.
*G09G 3/28* (2006.01)

(52) U.S. Cl. ..... 345/67

(58) Field of Classification Search ..... 345/60, 345/67, 204, 63; 315/169.4
See application file for complete search history.

(56) References Cited

U.S. PATENT DOCUMENTS

| | | | | |
|---|---|---|---|---|
| 6,160,530 | A * | 12/2000 | Makino | 345/67 |
| 6,624,798 | B1 * | 9/2003 | Aoki et al. | 345/60 |
| 6,738,033 | B1 * | 5/2004 | Hibino et al. | 345/67 |
| 2002/0195963 | A1 * | 12/2002 | Tokunaga et al. | 315/169.3 |

FOREIGN PATENT DOCUMENTS

| | | | |
|---|---|---|---|
| JP | 10-123998 | A | 5/1998 |
| JP | 10-187093 | A | 7/1998 |
| JP | 2000-206919 | | 7/2000 |
| JP | 2001-013913 | A | 1/2001 |
| JP | 2002-215090 | A | 7/2002 |
| KR | 2001-001585 | | 1/2001 |
| KR | 1020020010044 | A | 2/2002 |

* cited by examiner

*Primary Examiner*—Chanh Nguyen
*Assistant Examiner*—Allison Walthall
(74) *Attorney, Agent, or Firm*—McKenna Long & Aldridge LLP

(57) ABSTRACT

The present invention relates to a plasma display panel, and more particularly, to a plasma display apparatus and a method of driving a plasma display panel including address electrodes (X) and scan electrodes (Y). The plasma display apparatus according to the present invention includes a plasma display panel including a plurality of scan electrodes and a plurality of address electrodes formed to cross the scan electrodes; a driving unit for driving the plurality of address electrodes; and a driving pulse controller for controlling the driving unit so that a voltage falling time of a data pulse supplied to one and more address electrode groups among a plurality of address electrode groups including one or more address electrodes in an address period ranges from no less than 50 ns to no more than 300 ns. According to The present invention, electric potential of the data pulse varies slowly by prolonging a voltage falling time of a data pulse compared with a conventional voltage falling time so that the peak value of a displacement current becomes reduced. Accordingly, an EMI (ElectroMagnetic Interference) property is enhanced, thereby ensuring normal operations of a driving apparatus of a plasma display panel.

20 Claims, 9 Drawing Sheets

PLASMA DISPLAY APPARATUS WHICH HAS AN IMPROVED DATA PULSE AND METHOD FOR DRIVING THE SAME

This Nonprovisional application claims priority under 35 U.S.C. § 119(a) on Patent Application No. 10-2004-050839 filed in Korea on Jun. 30, 2004 the entire contents of which are hereby incorporated by reference.

BACKGROUND OF THE INVENTION

1. Field of the Invention

The present invention relates to a plasma display apparatus, and more particularly, to a plasma display apparatus and a method of driving a plasma display apparatus including address electrodes (X) and scan electrodes (Y).

2. Description of the Background Art

In general, a plasma display panel excites phosphor due to 147 nm ultraviolet rays generated when an inert gas such as a combination of helium and xenon (He+Xe) or neon and xenon (Ne+Xe) is discharged, thereby displaying an image including characters or graphics.

FIG. 1 is a perspective view illustrating a structure of a general plasma display panel.

As shown in FIG. 1, the plasma display panel comprises a scan electrode 12A (Y) and a sustain electrode 12B (Z) formed on an upper substrate 10, and an address electrode 20 (X) formed on a lower substrate 18.

The scan electrode 12A (Y) and the sustain electrode 12B (Z) include a transparent electrode and a bus electrode, respectively. The transparent electrode is made of Indium-Tin-Oxide (ITO). The bus electrode is made of metal for reducing resistance.

An upper dielectric layer 14 and a protection layer 16 are sequentially laminated on the top of the upper substrate 10 on which the scan electrode 12A and the sustain electrode 12B are formed.

Wall charge is charged on the upper dielectric layer 14, the wall charge being generated when plasma is discharged. The protection layer 16 prevents the upper dielectric layer 14 from damaging due to sputtering generated when plasma is discharged and enhances efficiency of second electron emission at the same time. The protection layer 16 is usually made of magnesium oxide (MgO).

Meanwhile, the lower dielectric layer 22 and a barrier rib 24 are sequentially formed on the top of the lower substrate 18 on which the address electrode 20 (X) is formed. A phosphor layer 26 is coated on the surface of the lower dielectric layer 22 and the barrier rib 24.

The address electrode 20 is formed in the direction to cross the scan electrode 12A and the sustain electrode 12B. The barrier rib 24 is formed parallel with the address electrode 20 to prevent ultraviolet rays and visible rays generated by discharge from being leaked to adjacent discharge cells.

The phosphor layer 26 is excited due to ultraviolet rays generated when plasma is discharged to generate any one visible ray of red, green and blue. An inert gas for discharge such as a combination of helium and xenon (He+Xe) or neon and xenon (Ne+Xe) is injected in discharge space of a discharge cell formed between the upper/lower substrate 10 or 18 and the barrier rib 24.

Predetermined driving apparatus are combined in a plasma display panel with such a construction so that a plasma display apparatus is formed.

FIG. 2 is a schematic circuit diagram illustrating a driving apparatus of a general plasma display panel.

Referring to FIG. 2, if a channel corresponding to a first scan electrode (Y1) is selected in a scanning process, channels corresponding to the rest of the scan electrodes (Y2, Y3, . . . , Yn) are not selected.

If a channel is selected in such a manner, a second switching element 213-1 of a first scan driver 210-1 corresponding to the selected channel and a switching element 220 for scanning are turned on.

At the same time, a first switching elements 211-2 to **211-*n* of scan drivers 210-2 to 210-*n* corresponding to the channels which are not selected and a switching element 230** for grounding are turned on.

If the switching elements operate in such a manner and a data voltage (+Vd or 0V) is applied to address electrodes (X1 to Xm) due to operations of first data switching elements 310-1 to **310-*m* or second data switching elements 320-1 to 320-*m* of a data driver IC 300**. Therefore, write operations are performed within cells located on a first line.

Further, a data pulse is grounded via the first switching elements 211-2 to **211-*n* of the scan drivers 210-2 to 210-*n* corresponding to the rest of the scan electrodes (Y2 to Yn) and the switching element 230** for grounding.

If such a process is performed on all the scan electrodes, a scanning process is finished.

After the scanning process, a first switching element 240 for sustaining, second switching elements 213-2 to **213-*n* of the scan drivers 210-1 to 210-*n* and a switching element 260** for grounding are turned on.

Accordingly, a first sustain voltage (+Vsy), the first switching element 240 for sustaining, the second switching elements 213-2 to **213-*n* of the scan drivers 210-1 to 210-*n*, each of the scan electrodes (Y1 to Yn), the sustain electrodes (Z1 to Zn) and the switching element 260 for grounding make a loop so that the sustain voltage (+Vsy) is applied to the scan electrodes (Y1** to Yn).

Next, a second switching element 250, the first switching elements 211-2 to **211-*n* of the scan drivers 210-1 to 210-*n* and the switching element 230** for grounding are turned on.

Accordingly, a second sustain voltage (+Vsz), the sustain electrodes (Z1 to Zn), the scan electrodes (Y1 to Yn), the first switching elements 211-2 to **211-*n* of the scan drivers 210-1 to 210-*n* and the switching element 230 for grounding make a loop so that the sustain voltage (+Vsz) is applied to the sustain electrodes (Z1** to Zn).

Such a driving apparatus of the plasma display panel applies a scan voltage (−Vyscan) and a data voltage (+Vd or 0V) to corresponding electrodes through switching operations of switching elements included in the scan drivers 210-1 to **210-*n* and data driver ICs 300-1 to 300-*m* in the scan period, and a displacement current (Id) flows in the data driver ICs 300-1 to 300-*m*** through the address electrodes in this process.

Since a general plasma display panel has a three-electrode structure, a first equivalent capacitor (Cm1) exists between two data electrodes adjacent to each other, and a second equivalent capacitor (Cm2) exists between a data electrode and a scan electrode, or a address electrode and a sustain electrode as shown in FIG. 2

Thus, since the state of a voltage applied to the electrodes varies depending on the operations of the switching elements included in the scan drivers 210-1 to **210-*n* and the data driver ICs 300-1 to 300-*m* in a scanning process, the displacement current (Id) generated due to the first equivalent capacitor (Cm1) and the second equivalent capacitor (Cm2) flows in the data driver ICs 300-1 to 300-*m***) through the address electrodes (X).

The magnitude of a displacement current flowing in such data driver ICs 300-1 to **300-*m*** can be expressed in equation 1 as follows:

$$id = C \times (dv/dt) \times f \quad \text{EQUATION 1}$$

"id" means the magnitude of a displacement current flowing through a data electrode, "C" means a capacitance between two data electrodes adjacent to each other, a data electrode and a scan electrode, or a data electrode and a sustain electrode, "dv/dt" means the variation of a voltage per time in a data electrode, and "f" means the number of voltage variance times of a data electrode.

FIG. 3 is a waveform diagram illustrating a data and a scan pulses applied to address and scan electrodes in a conventional scanning process.

As shown in FIG. 3, in the scanning process of a plasma display panel, a scan pulse is applied to each of the scan electrodes and a corresponding data pulse is simultaneously applied to the whole address electrodes. Accordingly, address discharge is generated due to a voltage difference between the scan pulse applied to the scan electrodes and the data pulse applied to the address electrodes.

Meanwhile, falling intervals (Tf1, Tf2) of such conventional data and scan pulses are synchronized so that they have the same falling time.

Thus, the falling interval (Tf1) of the data pulse becomes the same as the falling interval (Tf2) of the scan pulse so that electric potential of the data pulse varies rapidly in the falling interval (Tf1).

As described above, since the electric potential of the data pulse varies rapidly in the falling interval (Tf1), dv/dt in the equation 1 becomes large so that the peak of a displacement current becomes large, thereby deteriorating an EMI (ElectroMagnetic Interference) property. Therefore, there is a serious effect on a driving apparatus of a plasma display panel.

SUMMARY OF THE INVENTION

Accordingly, an object of the present invention is to solve at least the problems and disadvantages of the background art.

An object of the present invention is to provide a plasma display apparatus and a method of driving a plasma display panel which are capable of minimizing a displacement current.

To achieve these and other advantages and in accordance with the purpose of the present invention, as embodied and broadly described, there is provided a plasma display apparatus including a plasma display panel including a plurality of scan electrodes and a plurality of address electrodes formed to cross the scan electrodes; a driving unit for driving the plurality of address electrodes; and a driving pulse controller for controlling the driving unit so that a voltage falling time of a data pulse supplied to one and more address electrode groups among a plurality of address electrode groups including one or more address electrodes in an address period ranges from no less than 50 ns to no more than 300 ns.

In another aspect of the present invention, there is provide a method of driving a plasma display panel including a plurality of scan electrodes and a plurality of address electrodes formed to cross the plurality of scan electrodes, wherein a voltage failing time of a data pulse supplied to one and more address electrode groups among a plurality of address electrode groups each including one or more address electrodes in an address period ranges from no less than 50 ns to no more than 300 ns.

According to The present invention, electric potential of the data pulse varies slowly by prolonging a voltage falling time of a data pulse compared with a conventional voltage falling time so that the peak value of a displacement current becomes reduced. Accordingly, an EMI (ElectroMagnetic Interference) property is enhanced, thereby ensuring normal operations of a driving apparatus of a plasma display panel.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
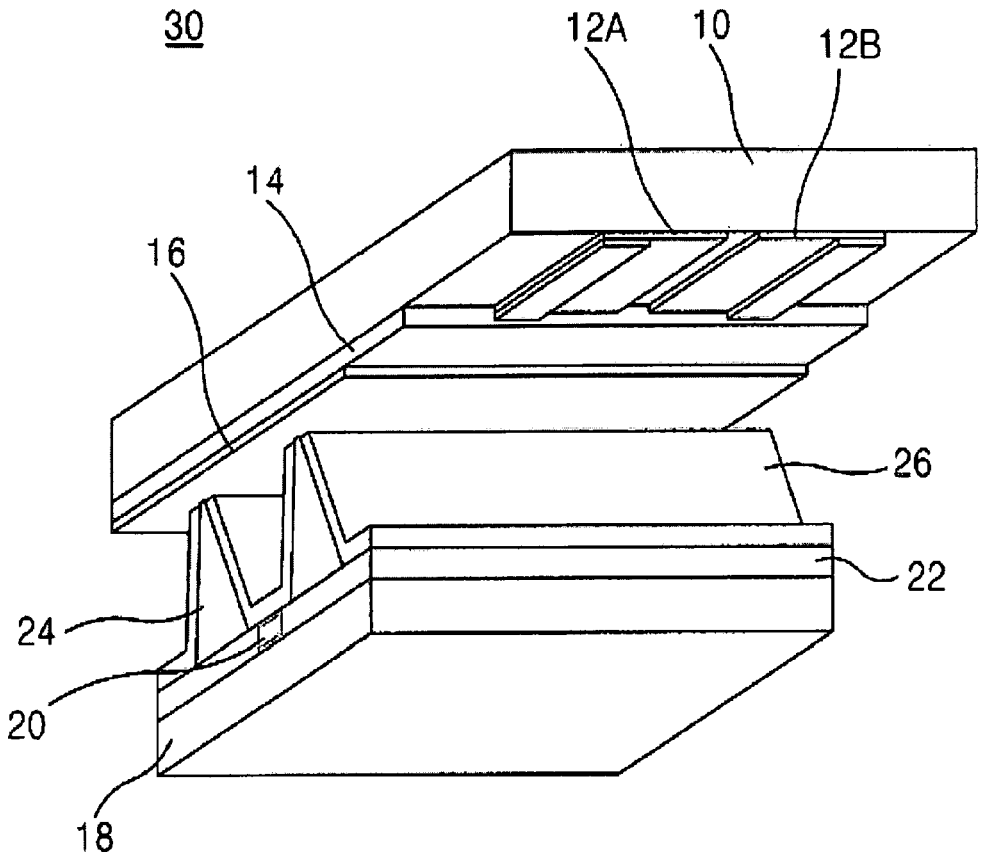
Fig. 1 Related Art
FIG. 1 is a perspective view illustrating a structure of a general plasma display panel.
Figure 2:
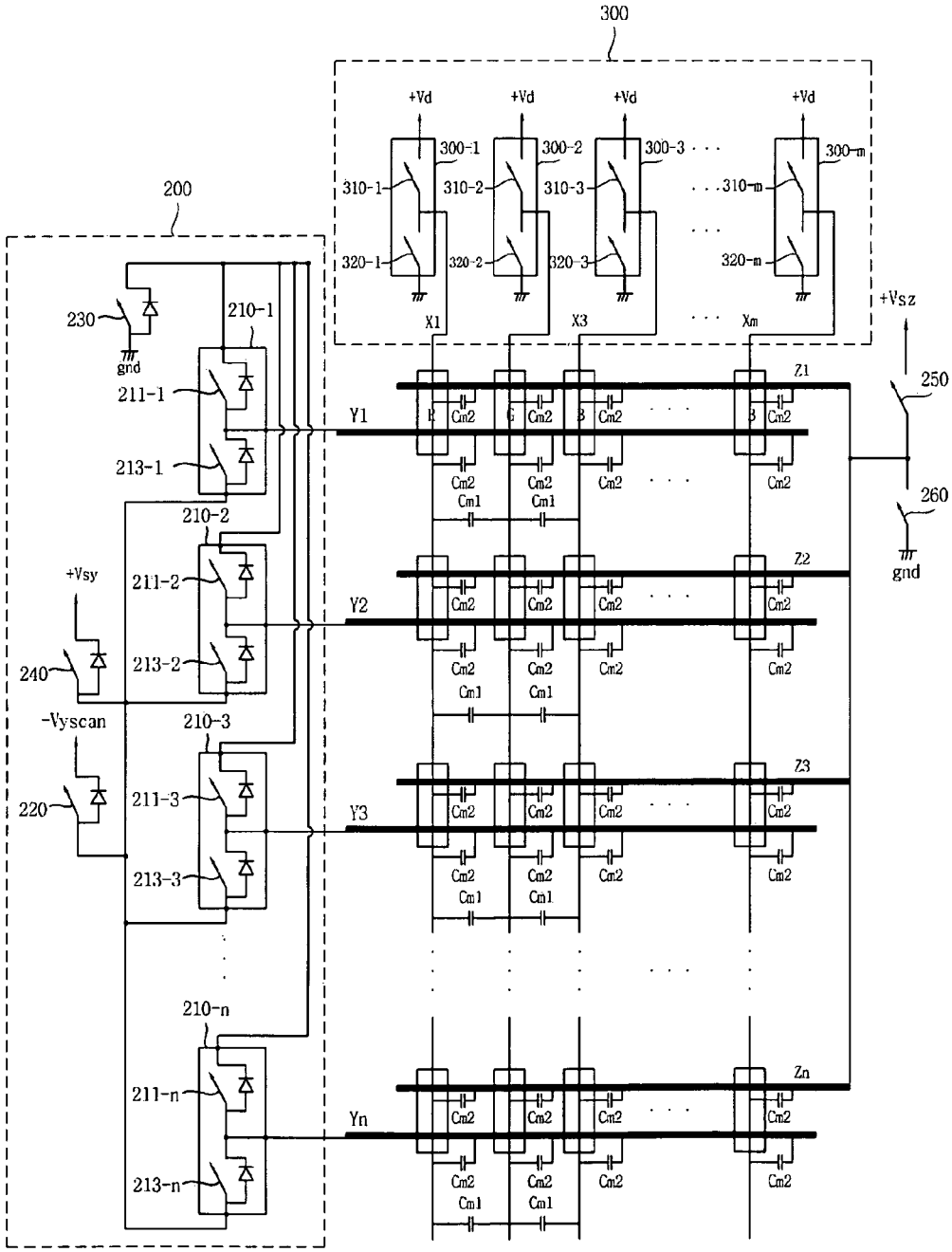
Fig. 2 Related Art
FIG. 2 is a schematic circuit diagram illustrating a driving apparatus of a general plasma display panel.
Figure 3:
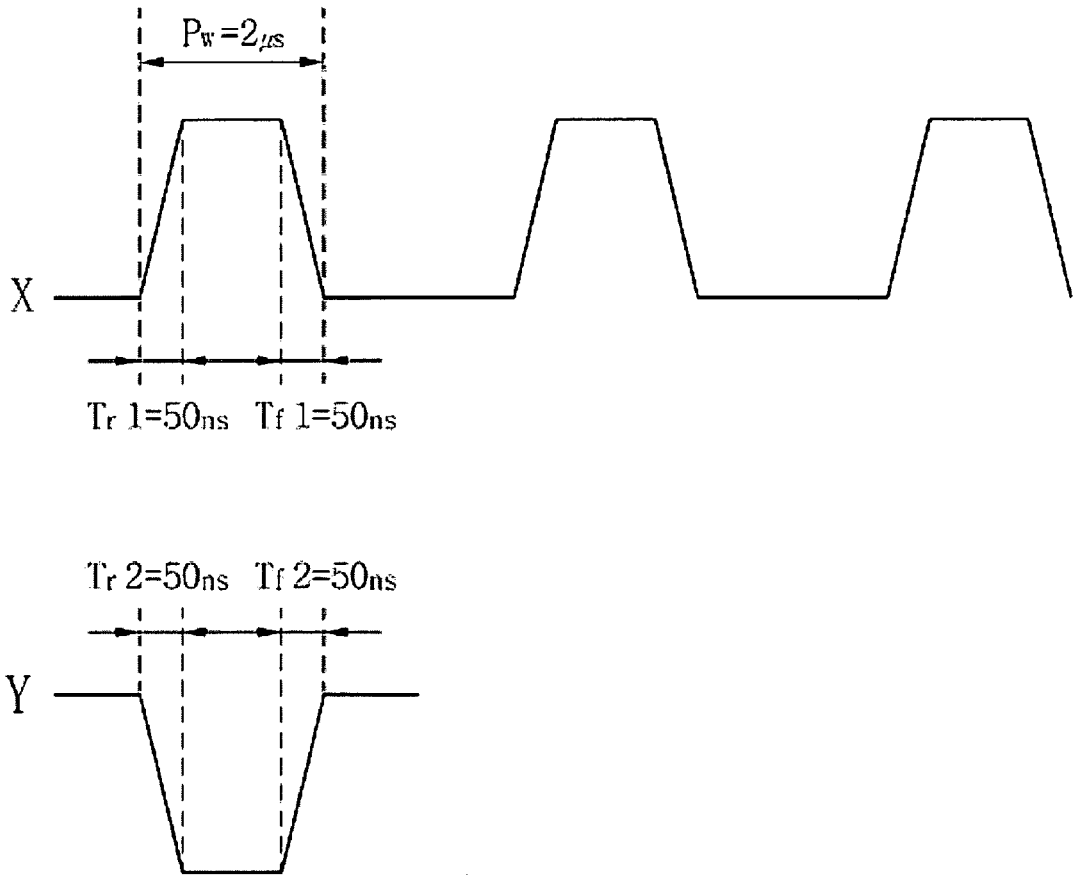
Fig. 3 Related Art
FIG. 3 is a waveform diagram illustrating a data and a scan pulses applied to address and scan electrodes in a conventional scanning process.

Preferred embodiments of the present invention will be described in a more detailed manner with reference to the drawings.

A plasma display apparatus according to an embodiment of the present invention includes a plasma display panel including a plurality of scan electrodes and a plurality of address electrodes formed to cross the scan electrodes; a driving unit for driving the plurality of address electrodes; and a driving pulse controller for controlling the driving unit so that a voltage falling time of a data pulse supplied to one and more address electrode groups among a plurality of address electrode groups including one or more address electrodes in an address period ranges from no less than 50 ns to no more than 300 ns.

Preferably, the voltage falling time of the data pulse is a time when a voltage of the data pulse falls from a data voltage (Vd) to a reference voltage.

Preferably, the number of the plurality of address electrode groups ranges from no less than two to no more than the total number of the plurality of address electrodes.

Preferably, the plurality of address electrode groups each includes the same number of address electrodes.

Preferably, wherein the driving pulse controller controls so that voltage falling times of data pulses supplied to a plurality of address electrodes included in the same address electrode group are all the same.

Preferably, the driving pulse controller controls so that the voltage falling times of the data pulses supplied to the plurality of address electrode groups have no less than three different values, and that differences between two data pulses whose voltage falling times are different each other among the data pulses supplied to the plurality of address electrode groups are all the same.

Preferably, the driving pulse controller controls so that a data rising time of the data pulse and a voltage falling time of the data pulse are different each other in address electrode groups to which a voltage falling time of the data pulse supplied among the plurality of address electrodes ranges from no less than 50 ns to no more than 300 ns.

Preferably, the driving pulse controller controls so that the data rising time of the data pulse is shorter than the voltage falling time of the data pulse in address electrode groups to which a voltage falling time of a data pulse supplied among the plurality of address electrodes ranges from no less than 50 ns to no more than 300 ns.

Preferably, the driving pulse controller controls so that a maintenance time of the data pulse supplied to the plurality of address electrode groups ranges from no less than 1 μs to no more than 3 μs.

Preferably, the driving pulse controller controls so that the voltage falling time of the data pulse supplied to the plurality of address electrode groups and a voltage rising time of a scan pulse supplied to the scan electrodes are different each other.

A method of driving a plasma display panel including a plurality of scan electrodes and a plurality of address electrodes formed to cross the plurality of scan electrodes in accordance with an embodiment of the present invention, wherein a voltage falling time of a data pulse supplied to one and more address electrode groups among a plurality of address electrode groups each including one or more address electrodes in an address period ranges from no less than 50 ns to no more than 300 ns.

Preferably, the voltage falling time of the data pulse is a time when a voltage of the data pulse falls from a data voltage (Vd) to a reference voltage.

Preferably, the number of the plurality of address electrode groups ranges from no less than two to no more than the total number of the plurality of address electrodes.

Preferably, the plurality of address electrode groups each includes the same number of address electrodes.

Preferably, the driving pulse controller controls so that voltage falling times of data pulses supplied to a plurality of address electrodes included in the same address electrode group are all the same.

Preferably, the driving pulse controller controls so that the voltage falling times of the data pulses supplied to the plurality of address electrode groups have no less than three different values, and that differences between two data pulses whose voltage falling times are different each other among the data pulses supplied to the plurality of address electrode groups are all the same.

Preferably, the driving pulse controller controls so that a data rising time of the data pulse and a voltage falling time of the data pulse are different each other in address electrode groups to which a voltage falling time of the data pulse supplied among the plurality of address electrodes ranges from no less than 50 ns to no more than 300 ns.

Preferably, the driving pulse controller controls so that the data rising time of the data pulse is shorter than the voltage falling time of the data pulse in address electrode groups to which a voltage falling time of a data pulse supplied among the plurality of address electrodes ranges from no less than 50 ns to no more than 300 ns.

Preferably, the driving pulse controller controls so that a maintenance time of the data pulse supplied to the plurality of address electrode groups ranges from no less than 1 μs to no more than 3 μs.

Preferably, the driving pulse controller controls so that the voltage falling time of the data pulse supplied to the plurality of address electrode groups and a voltage rising time of a scan pulse supplied to the scan electrodes are different each other.

Hereinafter, a plasma display apparatus and a method of driving a plasma display panel according to an embodiment of the present invention will be described in a more detailed manner with reference to the drawings.

Figure 4:
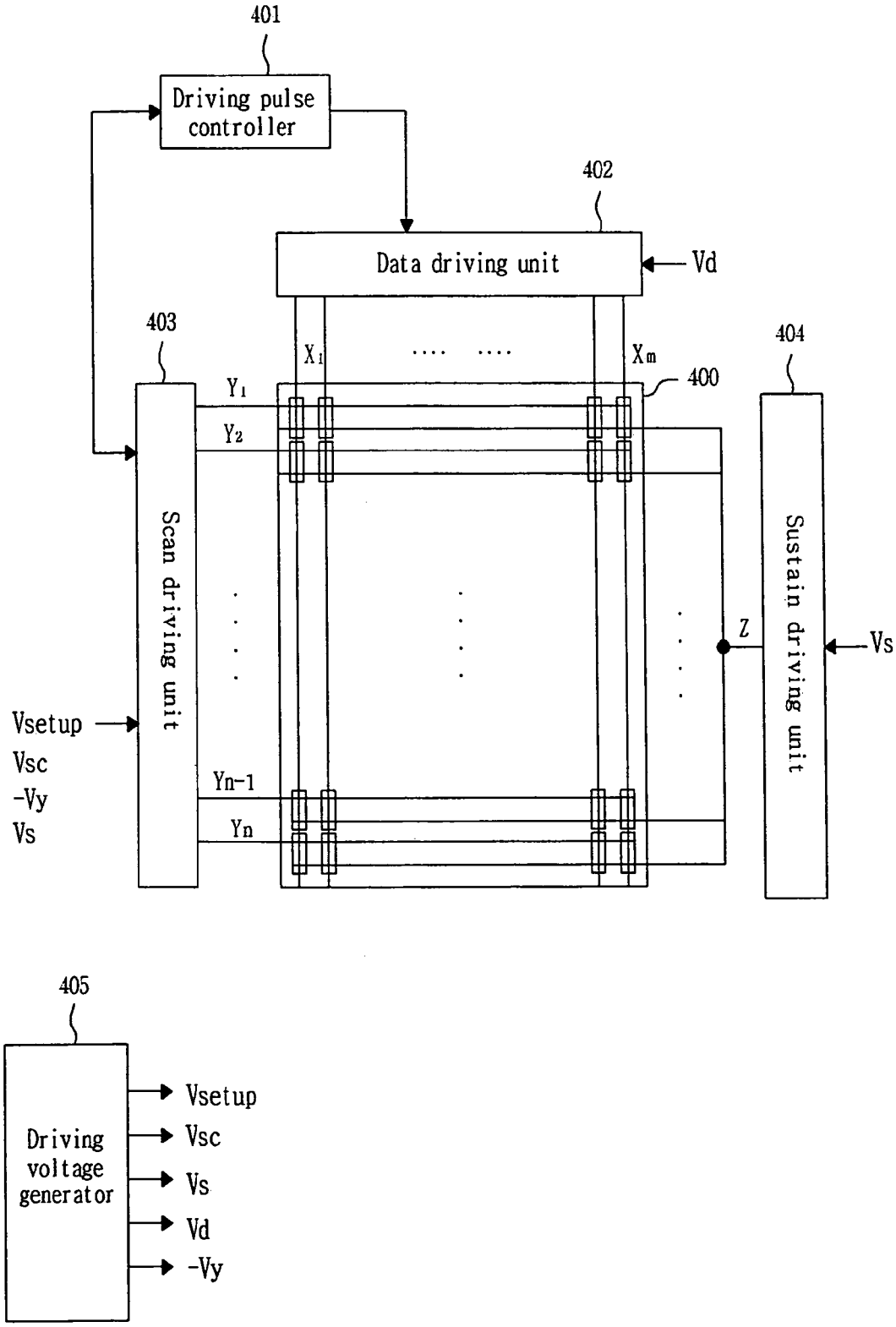
FIG. 4 is a view illustrating a plasma display apparatus according to the present invention.

FIG. 4 is a view illustrating a configuration of a plasma display apparatus according to the present invention.

As shown in FIG. 4, the plasma display apparatus according to the present invention includes a plasma display panel 400 including scan electrodes (Y), sustain electrodes (Z) and a plurality of address electrodes (X1 to Xm) formed to cross the scans electrodes (Y) and sustain electrodes (Z), and for displaying a picture made of a frame by a combination of at least one or more sub-fields in which a driving pulse is applied to the address electrodes (X1 to Xm), the scan electrodes (Y) and the sustain electrodes (Z) in a reset, an address and a sustain periods; a data driving unit 402 for supplying data to the data electrodes (X1 to Xm) formed in the plasma display panel 400; a scan driving unit 403 for driving the scan electrodes (Y1 to Yn); a sustain driving unit 404 for driving the sustain electrodes (Z) being common electrodes; a driving pulse controller 401 for controlling the data driving unit 402, the scan driving unit 404 when the plasma display panel 400 is driven; and a driving voltage generator 405 for supplying a driving voltage required in each of the driving units 402, 403 and 404.

Here, in the foregoing plasma display panel 400, a front panel (not shown) and a rear panel (not shown) are bonded together having a predetermined space therebetween. A plurality of electrodes, for example, the scan electrodes (Y1 to Yn) and the sustain electrodes (Z) are formed on the front panel making pairs of each of the scan and the sustain electrodes, and the data electrodes (X1 to Xm) are formed on the lower substrate to cross the scan electrodes (Y) and the sustain electrodes (Z).

Data are supplied to the data driving unit 402, the data being inverse gamma corrected and error diffused by a inverse gamma correction circuit (not shown) and an error diffusion circuit (not shown), and then being mapped to each sub-field by a sub-field mapping circuit (not shown). Such a data driving unit 402 supplies data supplied by control of the driving pulse controller 401 as a data pulse to the address electrodes (X1 to Xm).

The scan driving unit 403 supplies a reset pulse, for example, a reset pulse including a rising ramp waveform (Ramp-up) and a falling ramp waveform (Ramp-down) to the scan electrodes (Y1 to Yn) during a reset period. Further, the scan driving unit 403 sequentially supplies a scan pulse (Sp) of a scan voltage (−Vy) to the scan electrodes (Y1 to Yn) during an address period and supplies a sustain pulse (SUS) to the scan electrodes (Y1 to Yn) during a sustain period under the driving pulse controller 401.

The sustain driving unit 404 supplies a positive bias voltage (Vz) to the sustain electrodes (Z) during one or more periods of a period in which a falling ramp waveform (Ramp-down) is generated or an address period, and alternately operates with the scan driving unit 403 to supply a sustain pulse (SUS) to the sustain electrodes (Y) during a sustain period.

The driving pulse controller 401 controls the data driving unit 402 and scan driving unit 403 by generating a predetermined control signal for controlling operation timing and synchronization of the data driving unit 402 and the scan driving unit 403 and supplying the control signal to each of the data driving unit 402 and the scan driving unit 403 in a reset, address and sustain periods. Particularly, the driving pulse controller 401 controls the scan driving unit 403 and the data driving unit 402 in a plurality of sub-fields of a frame so that a voltage falling time of a data pulse supplied to one and more address electrode group of a plurality of address electrode groups each including one or more address electrodes ranges from no less than 50 ns to no more than 300 ns. Here, the foregoing voltage falling time of a data pulse is a time when a voltage of the data pulse falls from a voltage (Vd) to a reference voltage.

Further, it is preferred that such a driving pulse controller 401 controls a voltage falling time of a data pulse supplied to a plurality of address electrode groups and a voltage rising time supplied to scan electrodes to be different each other.

The driving voltage generator 405 generates a setup voltage (Vsetup), a scan reference voltage (Vsc), a negative scan voltage (−Vy), a sustain voltage (Vs), data voltages (Vd) and so on. Such driving voltages may vary depending on a composition of discharge gas or a structure of a discharge cell.

Prior to the explanation of a driving method of a plasma display apparatus according to the present invention, address electrode groups will first be described with reference to FIGS. 5*a* and 5*b* to understand a driving method of a plasma display panel according to the present invention.

Figure 5A:
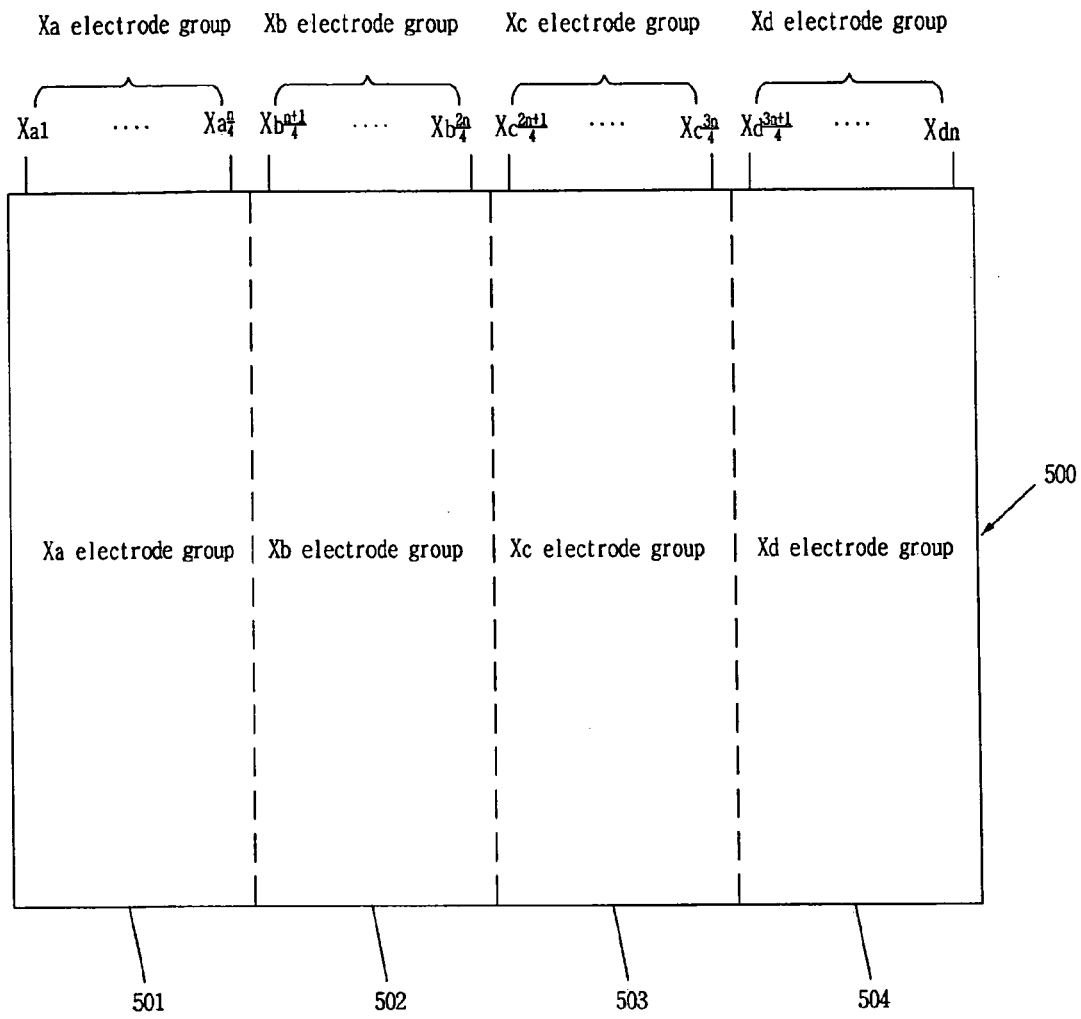
FIGS. 5*a* and 5*b* are views illustrating an exemplary method of dividing a plurality of address electrodes into a plurality of address groups each including one or more address electrodes.
Figure 5B:
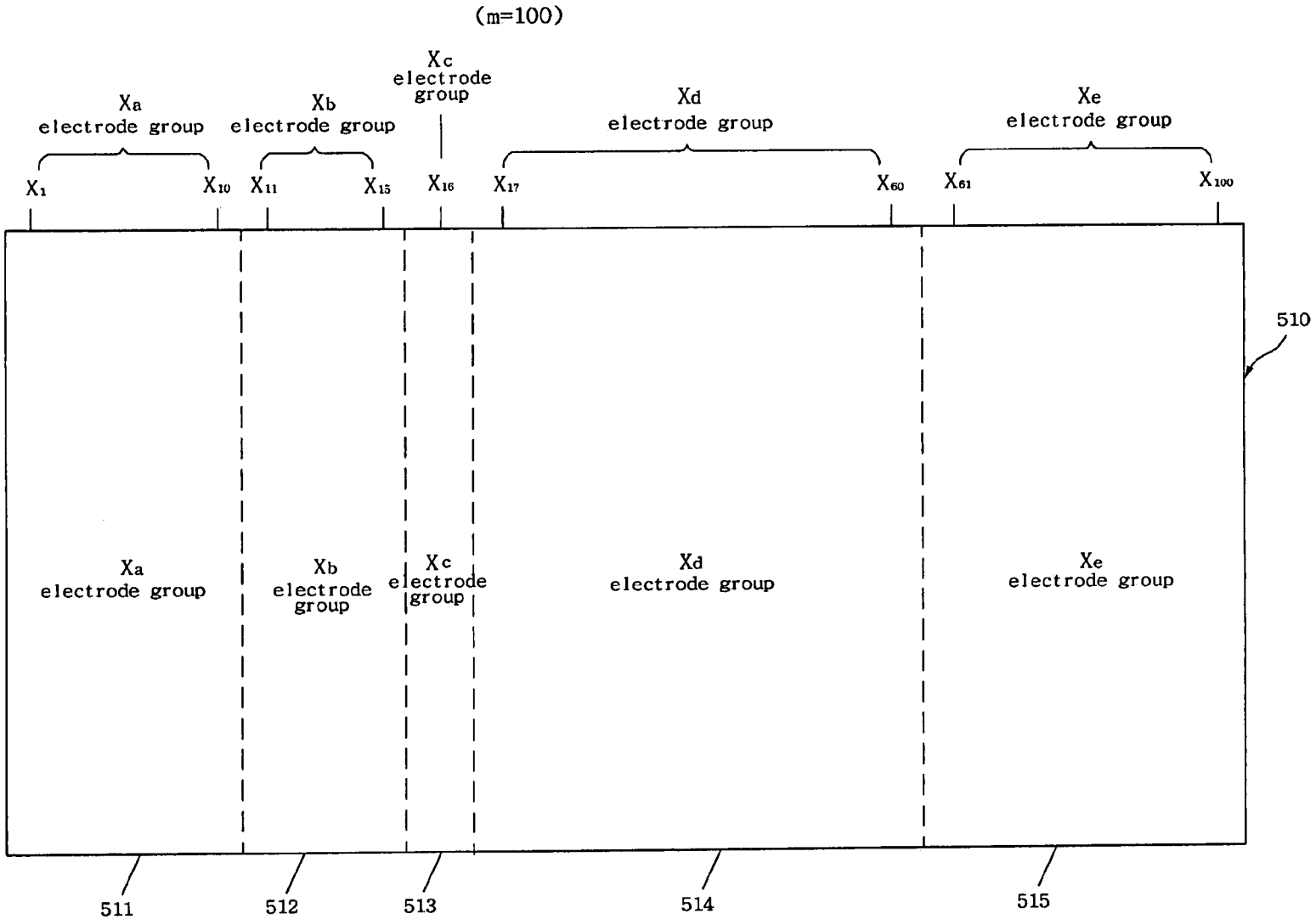

FIGS. 5*a* and 5*b* are views illustrating an exemplary method of dividing a plurality of address electrodes into a plurality of address groups each including one or more address electrodes.

First, Referring to FIG. 5*a*, the address electrodes (X1~Xm) formed in a plasma display panel are divided into four address electrode groups in FIG. 5*a* to illustrate a method of driving a plasma display panel according to the present invention.

In other words, the address electrodes (X1~Xm) of the plasma display panel 500, for example, are divided into an Xa electrode group 501 (Xa1~Xa(m)/4), an Xb electrode group 502 (Xb(m+1)/4~Xb(2m)/4), an Xc electrode group 503 (Xc(2 m+1)/4~Xc(3m)/4) and an Xd electrode group 504 (Xd(3 m+1)/4~Xdm). Here, the number of the foregoing address electrode groups can be set to range from at least no less than two to the number smaller than the total number of maximum address electrodes, that is, the number of $2 \leqq N \leqq (m-1)$, where m is the total number of address electrodes.

Meanwhile, the number of the address electrodes (X) included in each of the address electrode groups 501, 502, 503 and 504 are same in FIG. 5*a*, but it is possible to set the number of the address electrodes (X) included in each of the address electrode groups 501, 502, 503 and 504 to be different each other. Further, it is possible to adjust the number of the address electrode groups. An example of dividing such address electrodes will be described with reference to FIG. 5*b*.

As shown in FIG. 5*b*, if it is assumed that the total number of address electrode (X) of the plasma display panel 501 is 100, such address electrodes (X1~X100), for example, are divided into an Xa electrode group 511 (X1~X10), an Xb electrode group 512 (X11~X15), an Xc electrode group 513 (X16), an Xd electrode group 514 (X17~X60) and an Xe address electrode group 515 (X61~X100). Here, each of the address electrode groups includes the numbers of address electrodes (X) set to be different each other as described above.

Here, the foregoing Xc address electrode group 513 is an address electrode group including an address electrode, that is, X16 address electrode. This is a case that an address electrode (X) forms an address electrode group unlike other address electrode groups.

In this case, each of the address electrode groups includes the numbers of address electrodes set to be different each other. Contrary to this, only the predetermined number of address electrode groups selected among a plurality of address electrode groups may include the numbers of address electrodes set to be different from other address electrode groups. For example, in case that a plurality of address electrodes in a plasma display panel are divided into an Xa address electrode group, an Xb address electrode group, an Xc address electrode group, an Xd address electrode group, an Xe address electrode group and an Xf address electrode group, the Xa address electrode group includes total 10 address electrodes, the Xb address electrode group includes another 10 address electrodes and then the Xc, Xd, Xe and Xf address electrode groups each include 20 address electrodes.

It is preferred that voltage falling times of data pluses applied to the address electrodes (X) included in address electrode groups including a plurality of address electrodes among a plurality of address electrode groups divided in such a manner are all the same. In other words, voltage falling times of data pulses applied to the plurality of address electrodes (X) are same within address electrode groups including a plurality of address electrodes (X) among a plurality of address electrode groups. Such a voltage falling time of a data pulse will be more detailed through description of a method of driving a plasma display panel.

In a state that a plurality of address electrodes (X) are divided into a plurality of address electrode groups as shown in FIGS. 5*a* and 5*b*, a voltage falling time of a data pulse applied in an address period to one or more address electrode groups among a plurality of address electrode groups including one or more address electrodes (X) in a method of driving a plasma display panel according to the present invention is set to range from no less than 50 ns to no more than 300 ns. Such a method of driving a plasma display panel according to the present invention will be described with reference to FIG. 6.

Figure 6:
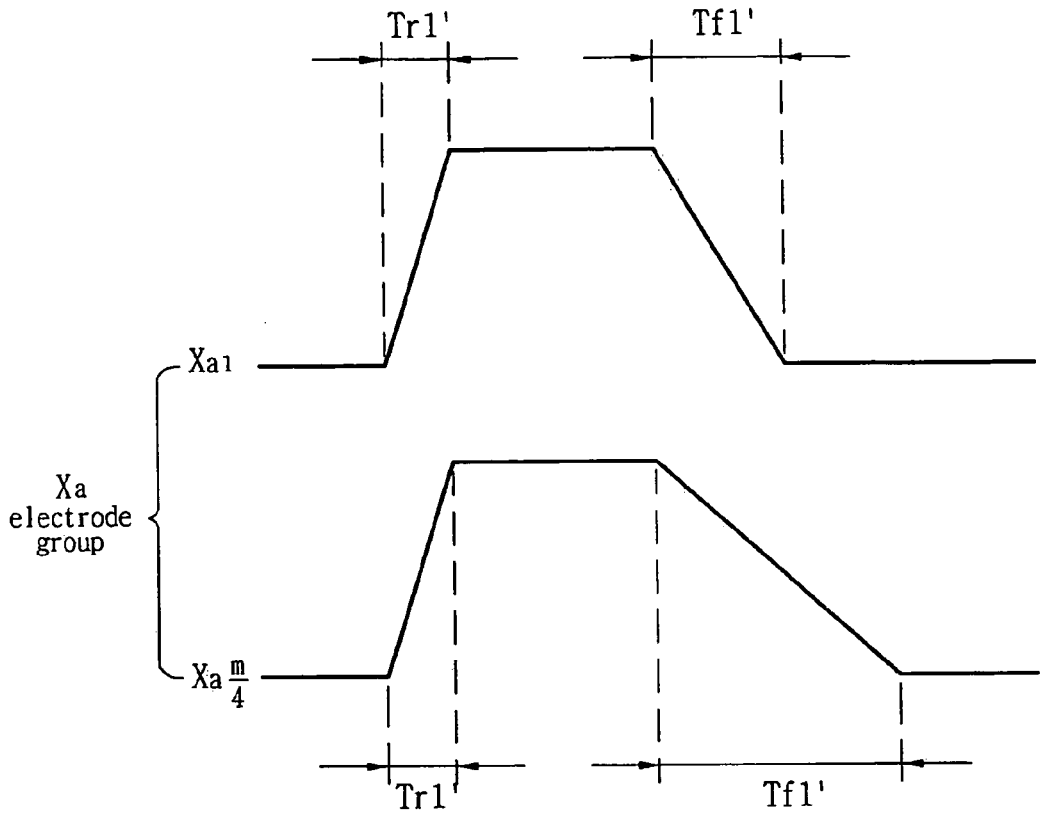
FIG. 6 is a view illustrating a method of driving a plasma display panel according to the present invention.

FIG. 6 is a view illustrating a method of driving a plasma display panel according to the present invention.

Referring to FIG. 6, a voltage falling time of a data pulse supplied to one or more address electrodes among a plurality of address electrode groups each including one or more address electrodes in an address period ranges from no less than 50 ns to no more than 300 ns.

In other words, in case that a plurality of address electrodes are divided into a plurality of address electrode groups as shown in FIGS. 5*a* and 5*b*, a voltage falling time (Tf1') of a data pulse supplied to the address electrodes (Xa1~Xa(m)/4) of the Xa electrode group ranges from no less than 50 ns to no more than 300 ns.

Such a voltage falling time (Tf1') of a data pulse is a time when a voltage of a data pulse falls from a data voltage (Vd) to a reference voltage, for a ground (GND) level voltage.

Here, it is preferred that voltage falling times of data pulses supplied to a plurality of address electrodes included in the same address electrode group are all the same as shown in FIG. 6. In other words, voltage falling times of data pulses supplied to the address electrodes (Xa1~Xa(m)/4) included in the Xa electrode group are all the same as Tf1' ranging from no less than 50 ns to no more than 300 ns as shown in FIG. 6.

Thus, it is possible that a voltage falling time of a data pulse is adjusted to range from no less than 50 ns to no more than 300 ns but that voltage falling times are set to be different each other among different address electrode groups. This will be described with reference to FIG. 7.

Figure 7:
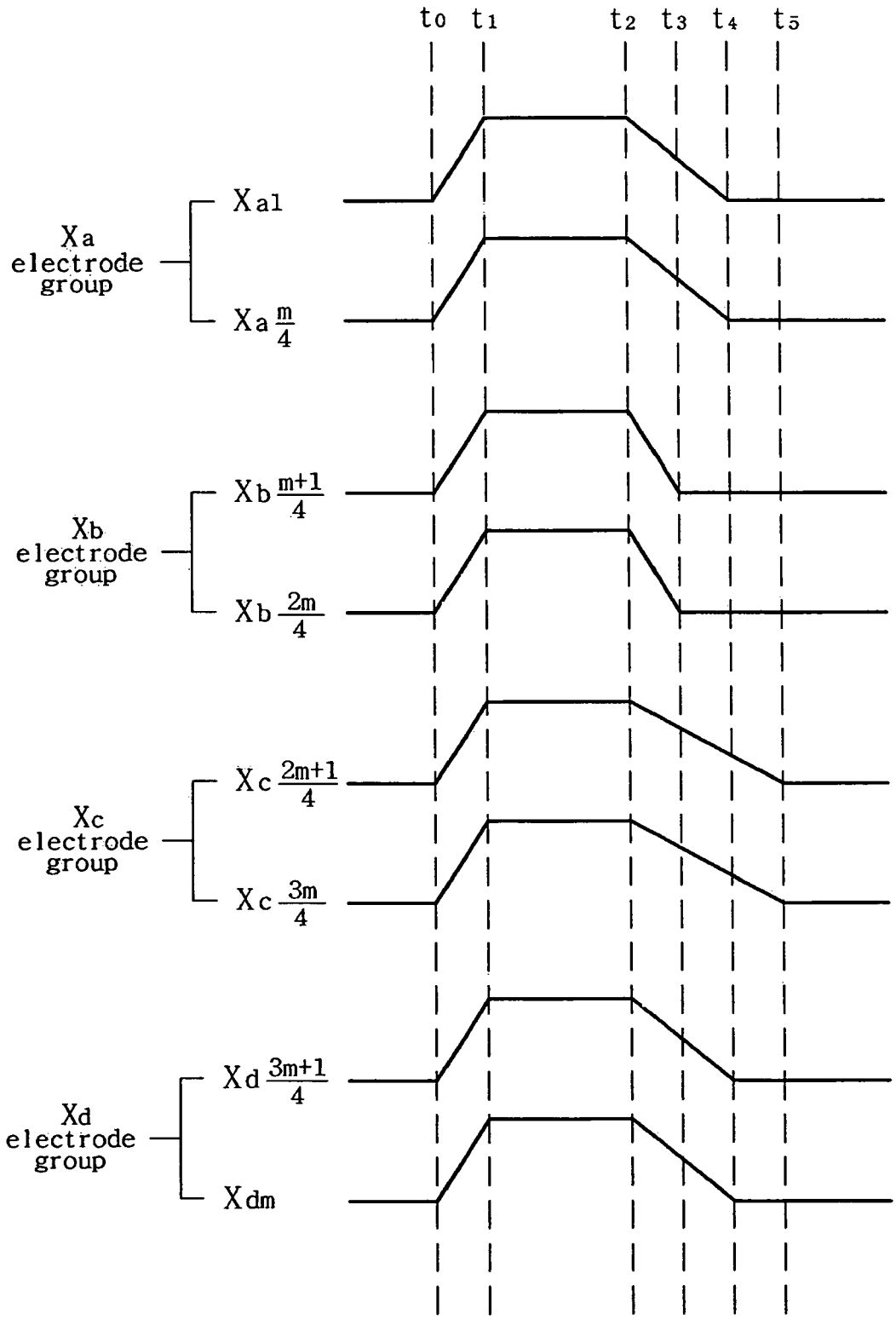
FIG. 7 is a view illustrating differences among data pulses supplied to address electrode group different each other.

FIG. 7 is a view illustrating differences among data pulses supplied to address electrode group different each other.

Referring to FIG. 7, a voltage falling time of a data pulse supplied to a plurality of address electrode groups has no less than three different values. For example, in case that address electrodes of a plasma display panel are divided into total four address electrode groups as shown in FIG. 7, a data pulse supplied to the Xa electrode group (Xa1~Xa(m)/4) falls from a data voltage (Vd) at a point t2 to a predetermined reference voltage, for example, a ground (GND) level voltage at a point t4. In other words, the voltage falling time of a data pulse is (t4−t2).

Further, a data pulse supplied to the Xb electrode group (Xb(m+1)/4~Xb(2m)/4) falls from a data voltage (Vd) at the point t2 to a predetermined reference voltage, for example, a ground (GND) level voltage at a point t3. In other words, the voltage falling time of a data pulse is (t3−t2).

Further, a data pulse supplied to the Xc electrode group (Xc(2 m+1)/4~Xb(3m)/4) falls from a data voltage (Vd) at the point t2 to a predetermined reference voltage, for example, a ground (GND) level voltage at a point t5. In other words, the voltage falling time of a data pulse is (t5−t2).

Further, a data pulse supplied to the Xd electrode group (Xd(3 m+1)/4~Xd(m)) falls from a data voltage (Vd) at the point t2 to a predetermined reference voltage, for example, a ground (GND) level voltage at the point t4. In other words, the voltage falling time of a data pulse is (t4−t2).

As described above, a voltage falling time of a data pulse supplied to an address electrode group is different from those of data pulses supplied to other address electrode groups.

Here, it is preferred that the differences of voltage falling times between two data pulses having different voltage falling times among data pulses supplied to a plurality of address electrode groups are all the same. In other words, the difference (t4−t3) between the voltage falling time (t4−t2) of a data pulse supplied to the Xa electrode group and the voltage falling time (t3−t2) of a data pulse supplied to the Xb electrode group is the same as the difference (t5−t4) between the voltage falling time (t4−t2) of a data pulse supplied to the Xa electrode group the voltage falling time (t5−t2) of a data pulse supplied to the Xc electrode group. In other words, (t4−t3) is the same as (t5−t4).

As described above, even in case that a voltage falling time of a data pulse supplied to an address electrode group is different from a voltage falling time of a data pulse supplied to another address electrode group, a voltage falling time of a data pulse supplied to one or more address electrode groups is set to range from no less than 50 ns to no more than 300 ns.

Further, in an address electrode group in which a voltage falling time of a data pulse supplied in such a manner is set to range from no less than 50 ns to no more than 300 ns, a voltage rising time of a data pulse is set to be different from a voltage falling time of the data pulse. More preferably, in an address electrode group in which a voltage falling time of a supplied data pulse is set to range from no less than 50 ns to no more than 300 ns, a voltage rising time of a data pulse is shorter than a voltage falling time of the data pulse.

As described above, in case that a voltage falling time of a data pulse supplied to one or more address electrodes is adjusted to range from no less than 50 ns to no more than 300 ns, it is possible that a voltage rising time of a scan pulse supplied to scan electrodes becomes different from a voltage falling time of a data pulse. This will be described with reference to FIG. 8.

Figure 8:
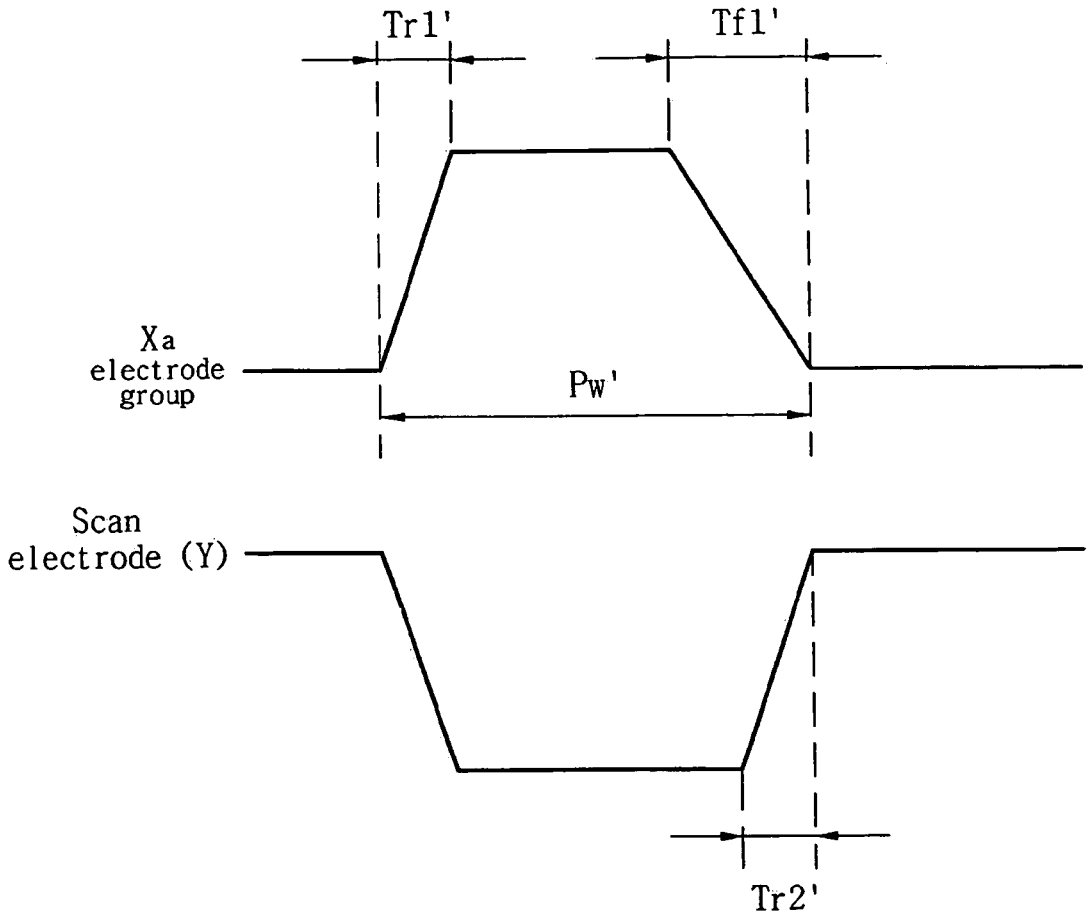
FIG. 8 is a view illustrating a relationship between a scan pulse and a data pulse in a method of driving a plasma display panel according to the present invention.

FIG. 8 is a view illustrating a relationship between a scan pulse and a data pulse in a method of driving a plasma display panel according to the present invention.

Referring to FIG. 8, in a method of driving a plasma display panel according to the present invention, a voltage falling time of the data pulse supplied to a plurality of address electrodes is different from a voltage rising time of the supplied scan pulse. In other words, Tf1' of a data pulse supplied to the Xa electrode group is synchronized with such a data pulse so that Tr2' of a scan pulse supplied to scan electrodes has a different length from Tf1' as shown in FIG. 8.

Here, it is preferred that a maintenance time (Pw') of a data pulse supplied to a plurality of address electrode groups is adjusted to range from no less than 1 μs to no more than 3 μs, thereby providing a sufficient maintenance time for address discharge.

As described above, since a voltage falling time of a data pulse supplied in a method of driving a plasma display panel according to the present invention is set to range from no less than 50 ns to no more than 300 ns so that electric potential of the data pulse varies slowly compared with a conventional electric potential of a data pulse, a magnitude of dv/dt in the foregoing equation 1 becomes small so that the peak value of a displacement current also becomes small. Accordingly, an EMI (ElectroMagnetic Interference) property is enhanced, thereby ensuring normal operations of a driving apparatus of a plasma display panel.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a plasma display panel including a plurality of scan electrodes and a plurality of address electrodes formed to cross the scan electrodes;

a driving unit for driving the plurality of address electrodes; and a driving pulse controller for controlling the driving unit so that a voltage falling time of a data pulse supplied to one and more address electrode groups among a plurality of address electrode groups including one or more address electrodes in an address period ranges from no less than 50 ns to no more than 300 ns, and the voltage falling time of a first data pulse supplied to a first address electrode group among the plurality of address electrode groups is different from the voltage falling time of a second data pulse supplied to a second address electrode group among the plurality of address electrode groups, wherein a time point of supplying of the first data pulse is substantially equal to a time point of supplying of the second data pulse.

2. The apparatus of claim 1, wherein the voltage falling time of the data pulse is a time when a voltage of the data pulse falls from a data voltage (Vd) to a reference voltage.

3. The apparatus of claim 1, wherein the number of the plurality of address electrode groups ranges from no less than two to no more than the total number of the plurality of address electrodes.

4. The apparatus of claim 1, wherein the plurality of address electrode groups each includes the same number of address electrodes.

5. The apparatus of claim 1, wherein the driving pulse controller controls so that voltage falling times of data pulses supplied to a plurality of address electrodes included in the same address electrode group are all the same.

6. The apparatus of claim 1, wherein the driving pulse controller controls so that the voltage falling times of the data pulses supplied to the plurality of address electrode groups have no less than three different values, and the difference between two of the different values is the same as the difference between another two of the different values.

7. The apparatus of claim 1, wherein the driving pulse controller controls so that a data rising time of the data pulse and a voltage falling time of the data pulse are different from each other in address electrode groups to which a voltage falling time of the data pulse supplied among the plurality of address electrodes ranges from no less than 50 ns to no more than 300 ns.

8. The apparatus of claim 1, wherein the driving pulse controller controls so that the data rising time of the data pulse is shorter than the voltage falling time of the data pulse in address electrode groups to which a voltage falling time of a data pulse supplied among the plurality of address electrodes ranges from no less than 50 ns to no more than 300 ns.

9. The apparatus of claim 1, wherein the driving pulse controller controls so that a maintenance time of the data pulse supplied to the plurality of address electrode groups granges from no less than 1 μs to no more than 3 μs.

10. The apparatus of claim 1, wherein the driving pulse controller controls so that the voltage falling time of the data pulse supplied to the plurality of address electrode groups and a voltage rising time of a scan pulse supplied to the scan electrodes are different each other.

11. A method of driving a plasma display panel including a plurality of scan electrodes and a plurality of address electrodes formed to cross the plurality of scan electrodes, wherein a voltage falling time of a data pulse supplied to one and more address electrode groups among a plurality of address electrode groups including one or more address electrodes in an address period ranges from no less than 50 ns to no more than 300 ns and the voltage falling time of a first data pulse supplied to a first address electrode group among the plurality of address electrode groups is different from the voltage falling time of a second data pulse supplied to a second address electrode group among the plurality of address electrode groups, wherein a time point of supplying of the first data pulse is substantially equal to a time point of supplying of the second data pulse.

12. The method of claim 11, wherein the voltage falling time of the data pulse is a time when a voltage of the data pulse falls from a data voltage (Vd) to a reference voltage.

13. The method of claim 11, wherein the number of the plurality of address electrode groups ranges from no less than two to no more than the total number of the plurality of address electrodes.

14. The method of claim 11, wherein the plurality of address electrode groups each includes the same number of address electrodes.

15. The method of claim 11, wherein the driving pulse controller controls so that voltage falling times of data pulses supplied to a plurality of address electrodes included in the same address electrode group are all the same.

16. The method of claim 11, wherein the driving pulse controller controls so that the voltage falling times of the data pulses supplied to the plurality of address electrode groups have no less than three different values, and the difference between two of the different values is the same as the difference between another two of the different values.

17. The method of claim 11, wherein the driving pulse controller controls so that a data rising time of the data pulse and a voltage falling time of the data pulse are different from each other in address electrode groups to which a voltage falling time of the data pulse supplied among the plurality of address electrodes ranges from no less than 50 ns to no more than 300 ns.

18. The method of claim 11, wherein the driving pulse controller controls so that the data rising time of the data pulse is shorter than the voltage falling time of the data pulse in address electrode groups to which a voltage falling time of a data pulse supplied among the plurality of address electrodes ranges from no less than 50 ns to no more than 300 ns.

19. The method of claim 11, wherein the driving pulse controller controls so that a maintenance time of the data pulse supplied to the plurality of address electrode groups ranges from no less than 1 μs to no more than 3 μs.

20. The method of claim 11, wherein the driving pulse controller controls so that the voltage falling time of the data pulse supplied to the plurality of address electrode groups and a voltage rising time of a scan pulse supplied to the scan electrodes are different from each other.

* * * * *